United States Patent [19]

Sable

[11] Patent Number: 4,589,483

[45] Date of Patent: May 20, 1986

[54] ROD CENTRALIZER

[76] Inventor: Donald E. Sable, 4100 Spring Valley Rd., #900, Dallas, Tex. 75240

[21] Appl. No.: 676,842

[22] Filed: Nov. 30, 1984

[51] Int. Cl.[4] ..... E21B 37/02; E21B 17/046

[52] U.S. Cl. ..... 166/176; 308/4 A; 403/372

[58] Field of Search ..... 166/176; 308/4 A; 403/344, 372

[56] References Cited

U.S. PATENT DOCUMENTS

| | | | |
|---|---|---|---|
| 2,928,472 | 3/1960 | Tripplehorn | 166/176 |
| 3,370,894 | 2/1968 | Pourchot | 308/4 A |
| 3,399,730 | 9/1968 | Pourchot | 166/176 |
| 3,507,525 | 4/1970 | Sable | 403/372 |
| 4,343,518 | 8/1982 | Pourchot | 166/176 X |

*Primary Examiner*—Stephen J. Novosad
*Assistant Examiner*—David J. Bagnell

[57] ABSTRACT

A well tool, such as a paraffin scraper or centralizer, installable on a rod of a pump rod string, which is composed of two longitudinal sections longitudinally movable relative to one another on a rod interposed therebetween into clamping locked position on the rod and a resilient longitudinal member compressed between one of the sections and the rod, the two sections having first co-engageable means for moving the two sections laterally relative to each other to compress the compressible member against the rod upon relative longitudinal movement of one section toward the other and a second co-engageable lock means for holding the two sections in longitudinally telescoped locked position on the rod.

1 Claim, 7 Drawing Figures

ROD CENTRALIZER

This invention relates to well tools and more particularly to well tools installable on rods of a pump rod string for use as scrapers or centralizers for holding the rods of the string in centralized positions in a well flow conductor and/or for scraping the internal surfaces of the well flow conductor to prevent accumulations thereon of paraffin or other substances.

BACKGROUND OF THE INVENTION

Rod guide and paraffin scraping devices of the type illustrated and described in the U.S. Pat. No. 3,399,730 are necessarily made of substantially rigid substances to reduce their wear by contact with the internal surfaces of the well flow conductor, such as a tubing string, during the reciprocation in the tubing string of the pump rod string on which they are installed. Since the diameters of the rods vary to some degree or another, as much as plus or minus ten thousandths of an inch, such conventional rod devices are provided with means, such as the internal longitudinal ribs described in the U.S. Pat. No. 3,399,730, which are intended to "bite into or cut through any corrosion or coating which may be present on the outer periphery of the rod . . . " In actual practice such ribs often tend to collapse or bend, and in any case the longitudinal spaces therebetween provide constricted longitudinal flow passages between the rods and the internal surfaces of such rod devices. Flow of well fluids, which often contain abrasive particles such as sand suspended therein, through such passages results in abrasion and weakening of the rods at the locations of these devices. In addition, the collapse or bending of such ribs which may occur during pumping due to contact of the devices with the internal surfaces of the well tubing results in loosening of such devices on the rods and their movement relative thereto as they contact the internal surfaces of the well tubing. Since the devices when used as centralizers or scrapers must be spaced at predetermined intervals on the rods to operate effectively, their displacement from their initial installed positions may result in undesired lateral displacement of some sections of the pump rod string when the devices are used as rod centralizers or in failure of the devices to scrape some portions of the internal surfaces of the flow conductor and thus accumulation of deposits of paraffin on such unscraped portions may occur.

It is desirable therefore that pump rod string devices such as centralizers and/or scrapers be provided which have means for rigidly holding the devices on the rods, which do not permit flow of fluids between the devices and the rods which may be formed of very rigid wear resistant substances and which are easily installable on the rods of the pump rod string.

Accordingly, it is an object of this invention to provide a new and improved well tool which is easily and rigidly installable on a rod.

Another object is to provide a well tool having a pair of complementary longitudinally telescopical sections which are rigidly securable on a rod upon longitudinal telescopical movement of one section relative to the other into locked relationship about the rod.

Still another object is to provide a well tool, of the type described, having a compressible member interposed between one section and the rod for enabling the installation of the well tool on rods of varying diameters.

Still another object is to provide a well tool, of the type described, wherein the complementary sections are provided with co-engageable tongue and groove means for moving said sections toward one another to compress the resilient member against the rod upon telescopical movement of one section relative to the other into locked position on the rod.

Still another object is to provide a well, tool, of the type described, wherein the two sections have co-engageable lock means for locking the sections to one another when installed on a rod.

An important object of the invention is to provide a well tool, of the type decribed, wherein the well tool section compressing the resilient member has a plurality of grooves for receiving portions of the resilient member as the resultient member is compressed against the rod whereby the well tool may be installed on rods of different diameters.

SUMMARY OF THE INVENTION

Briefly stated, the well tool embodying the invention includes two complementary longitudinal sections, having facing longitudinal substantially semi-circular recesses, which are positionable on and about a round rod, and a resilient longitudinal member interposed between one section and the rod, the two sections having co-engageable tongue and groove means for moving the two sections toward the rod upon telescopical longitudinal movement of one section relative to the other toward mutually locked positions on the rod, the two sections having co-engageable locking means for holding the two sections in operative locked position on the rod.

BRIEF DESCRIPTION OF THE DRAWINGS

Other objects and advantages of the invention will become apparent upon reading of the following description of several embodiments of the invention in connection with the accompanying drawings wherein.

Figure 1:
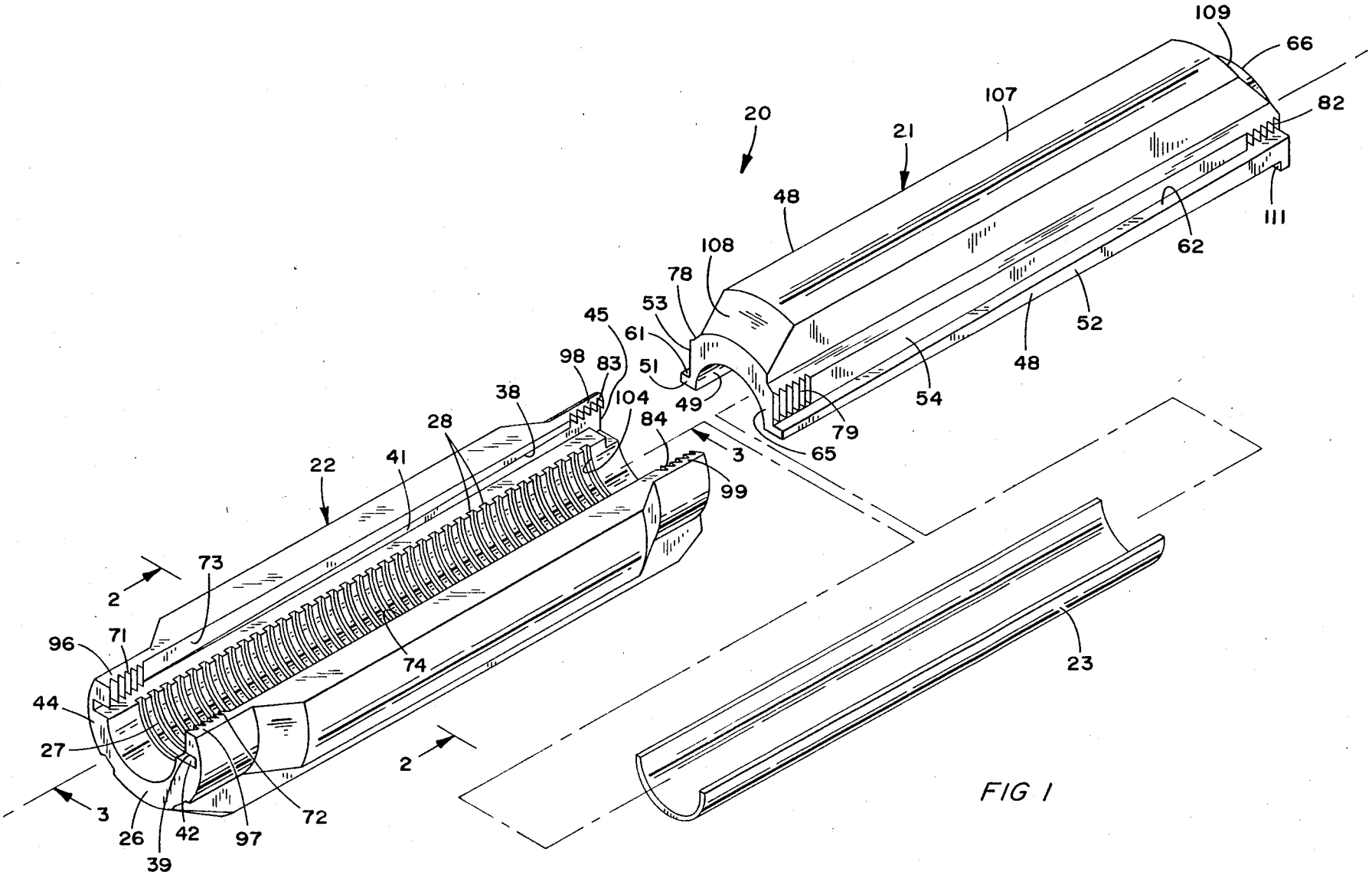
FIG. 1 is an exploded perspective view of one form of a well tool embodying the invention.
Figure 2:
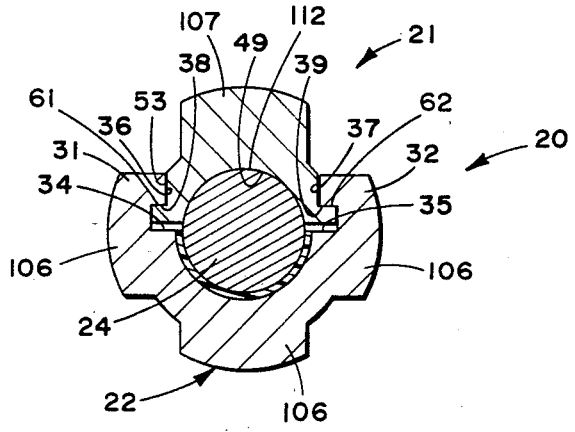
FIG. 2 is a cross-sectional view of the well tool of FIG. 1 shown mounted on a rod.

Referring now particularly to FIGS. 1 through 4 of the drawings, the well tool 20 embodying the invention comprises complementary tongue and groove sections 21 and 22, respectively, and a resilient compressible member 23 which are disposable about a rod 24 with the compressible member interposed and compressed between the groove section 23 and the rod 24.

The groove section 22 includes a substantially semi-cylindrical body 26 having an inner arcuate surface 27 of substantially the same radius as the rod 24. A plurality of longitudinally spaced substantially semi-circular grooves 28 extend into the body 26 from the surface 27 into which portions of the resilient compressible member may extrude or flow when the compressible member is compressed between the rod and the surface 27.

The groove section body includes longitudinal edge portions 31 and 32 extending upwardly from longitudinal-coplanar surfaces 34 and 35 and having longitudinal vertical facing surfaces 36 and 37, respectively, and downwardly facing surfaces 38 and 39, respectively, which, with the surfaces 34, 35, 36 and 37, define longitudinal grooves 41 and 42, respectively.

The downwardly facing longitudinal surfaces 38 and 39 slope upwardly from one end 44 of the section to the other end 45 thereof and thus constitutes cam surfaces as will be explained below.

The tongue section also includes a substantially semicylindrical body 48 having an inner arcuate surface 49 of substantially the same radius as the rod 24 which is adapted to slidably contact the rod as the tongue section moves into telescoped relation with the groove section to compress the compressible latch member between the groove section and the rod.

The tongue section has tongues 51 and 52, extending radially outwardly from vertical parallel side surfaces 53 and 54 of the tongue section body 48, which are slidably receivable in the longitudinal grooves 41 and 42 of the groove section body.

The tongues have upward longitudinal cam surfaces 61 and 62 which slope upwardly from the front end 65 of the tongue section body 48 to its opposite rear end 66. These tongue cam surfaces 61 and 62 are slidably engageable with the similarly sloping surfaces 38 and 39, respectively, of the groove section body.

The tongues of the tongue section body at each location along their length are of slightly smaller height than the height of the grooves 41 and 42, when the two sections are in fully telescoped position, so that as the two sections move toward their fully telescoped positions, the camming action between the sloped surfaces of the tongues and grooves will move the groove section toward the tongue section and will thus compress the compression or latch member between the rod and the groove section.

The compression member is formed of any suitable resiliently compressible substance which will not deteriorate under the conditions present in the tubing string as may be determined by the chemical composition of the well fluids, pressures and temperatures in the flow conductor of a particular well. For example, the compressible member may be formed of plastics such as are commercially available under the name "Nylon" and "Teflon".

The substance of the compressible member allows portions of the compressible member to be deformed or flow into the grooves 28 of the groove body as the groove section body is moved toward the rod and the tongue section body is slid longitudinally over the rod toward fully telescoped and locked position with the groove section body on the rod.

As the tongue section body moves toward fully telescoped position on the groove section body, the two section bodies are locked against movement in the opposite direction by a front pair of facing sets of teeth 71 and 72 projecting inwardly toward one another from the facing vertical surfaces 73 and 74 of the groove section body, extending upwardly from the surfaces 38 and 39 defining the grooves 41 and 42. The sets of teeth 71 and 72 receivable in the complementary outwardly opening sets of teeth or grooves 78 and 79 in the front end portions of the vertical surfaces 53 and 54, respectively, of the tongue section body.

Similarly, the tongue section body is provided at its rear portion with sets 81 and 82 of teeth which project outwardly from the vertical side surfaces 53 and 54, respectively, of the tongue section body and which are receivable in the sets 83 and 84 of teeth or lock grooves in the vertical side surfaces 73 and 74, respectively, of the groove section body.

Figure 4:
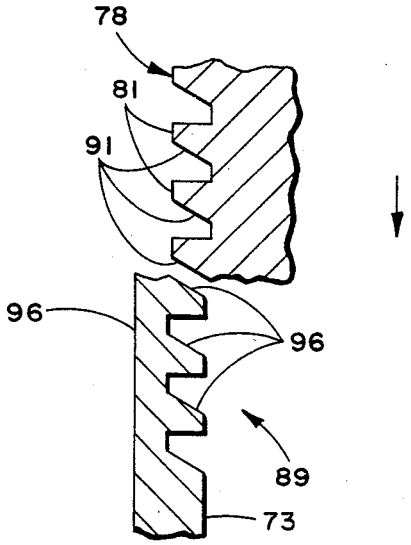
FIG. 4 is a fragmentary enlarged view of the locking means of the two sections.

As illustrated in FIG. 4, each of the teeth of the sets of locking teeth has a sloping side 91 extending rearwardly of the direction of locking telescopic movement of the tongue section relative to the groove body sections so that the camming sliding engagement of these sloping shoulders or surfaces with the rearwardly sloping surfaces 96 defining the rearwardly facing sides of the lock teeth grooves tends to exert an outwardly directed force on the front and rear portions 96 and 97, respectively, of the tongue body section provided with the sets 71 and 72 of teeth and the rear portions 98 and 99 provided with the sets 83 and 84 of teeth grooves.

As illustrated, these front and rear sections are reduced in thickness to facilitate their outwardly resilient flexing movement as the front and rear sets of teeth engage the rearwardly facing surfaces defining the lock or teeth grooves.

Figure 3:
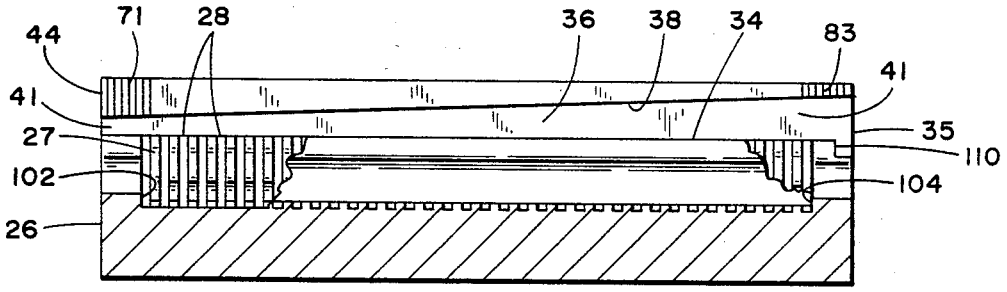
FIG. 3 is a longitudinally partly sectional view of the groove section of the well tool of FIGS. 1 and 2.

As seen in FIG. 3, the rear and front end portions of the surface 27 of the groove section body may be of slightly smaller radius than the intermediate portion which is provided with the grooves 28 but slightly greater than the radius of the rod, in order to provide shoulders 102 and 104 which act as positioning or stop means to position and hold the compression member 23 in proper relation to the groove section body.

The groove body section is provided with the longitudinal external ribs 106 while the tongue section is provided with a single annular external rib 107. The ends of each of the ribs, as at 108 and 109, thence extend convergently outwardly to facilitate longitudinal movement of the well tool past internal obstructions in the tubing string, as the ends of the tubing sections at the coupling collars of the tubing string.

In use, when it is desired to mount the well tool 20 on the rod 24, the compression member is placed in the groove body section between the shoulders 102 and 104 and this assembly is then positioned on the rod and held firmly thereon. The tongue section is then placed opposite and rearwardly of the groove section with the rod positioned therebetween and is moved forwardly so that the front narrow portions of the tongues 51 and 52 telescope into the large rear end portions of the grooves 41 and 42. As the telescoping movement continues, the camming engagement of the tongue surfaces 61 and 62 with the groove surfaces 38 and 39 moves the two sections toward one another with the compression or latch member being compressed agains the rod. As the sets of lock teeth begin to move progressively past the sets of teeth lock grooves, the front 96 and 97 and rear sections 98 and 99 of the groove section body flex outwardly to permit such movement.

The number of teeth positioned in the teeth grooves increases with the telescoping movement of the tongue section until the sections are rigidly secured to the rod. If desired, the two section bodies may be provided with stop shoulders 110 and 111 to limit forward movement of the tongue section relative to the groove section.

It will be apparent that if the rod diameter is greater than nominal, the degree of telescopic movement of the tongue section relative to the groove section will be less than if the diameter is less than nominal.

It will be apparent that the tongue section slides on and relative to the rod during the mounting of the well tool on the rod while the groove section is held against longitudinal movement relative to the rod.

When the rod string is lowered into the well tubing, it is exposed to the well fluid and to the higher temperatures of the well fluids. As a result, the compression member tends to expand or swell and thus the force with which the well tool is being held immovable on the rod is increased.

Since the portions 96, 97, 98 and 99 of the groove section, which must flex during movement of the tongue section to locked position on the groove section, are reduced in thickness, the well tool may be formed of a fairly reigid substance, such as is commercially available under the mark "RYTON", which is very durable and wear resistant.

It will now be seen that the well tool 20 when installed on a rod does not allow any longitudinally extending spaces between the rod and the well tool since the internal surface 49 of the tongue section 22 is of the same diameter as the rod and is held in tight engagement therewith by the compressed resilient compression member 23. The compression member, of course, seals between the internal surface 27 of the groove section and the rod as it is compressed therebetween.

It will be apparent that the sets 71 and 72 of the teeth of the groove sections and the sets 81 and 82 of the teeth of the tongue section are not contacted until the tongue section nears the end of its forward longitudinal movement relative to the groove section and the compression member is compressed as the groove section is moved toward the rod by the camming action of the rearwardly sloping surfaces 38 and 39 of the groove section and the similarly sloping surfaces 61 and 62 of the tongue section.

The number of teeth and the distance of telescoping movement of the tongue section relative to the groove section are selected to allow for a sufficient number of teeth to be engaged in the teeth grooves to prevent accidental rearward dislodgment of the tongue section from the groove section, as if a rearward force is exerted on the tongue section during movement of the rod in a flow conductor, it being apparent that if the rod is of greater than nominal diameter the possible telescopical movement of the tongue section will be less than if the rod is of less than nominal value. The thickness of the compression member is, of course, selected to ensure that the tool cam be rigidly secured on rods of normal variations of diameter.

It will be apparent that the tongue section must slide forward along the rod as the compression of the compression member commences and that the tongue member is held against rearward movement relative to the rod not only by the sets of teeth of the two sections, but also by frictional engagement of its internal surface 49 with the rod surface 112. The force of the frictional engagement is substantial since the rod is not polished and has protrusions which tend to bite into the tongue section. In addition, particles of foreign matter which may be present between the tongue section and the rod will also tend to dig or bite into the tongue section and may extend partially into any small depressions or pits in the rod.

Figure 5:
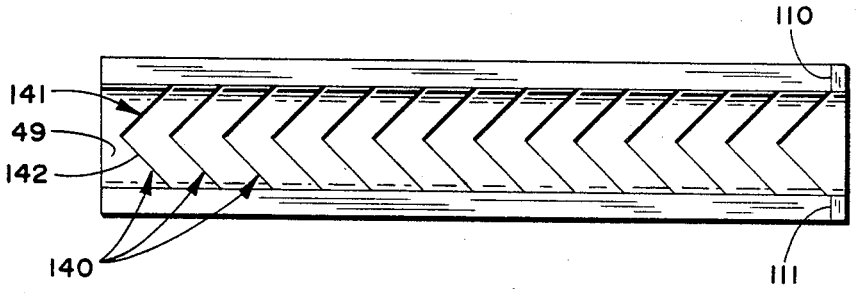
FIG. 5 is a bottom view of a modified form of the tongue section of the well tool.
Figure 6:
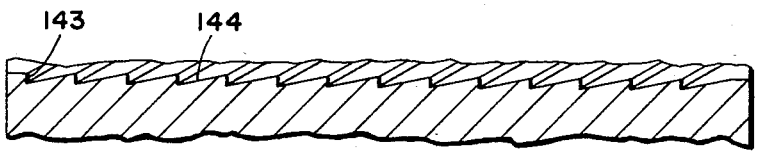
FIG. 6 is a fragmentary longitudinal sectional view of the tongue sections of FIG. 5.

If desired, as shown in FIGS. 5 and 6, the internal surface 49 of the tongue section may be provided with a plurality of grooves 140 each having portions 141 and 142 which slope rearwardly and outwardly from the longitudinal central axis of the surface 49.

Each of these grooves is defined by an abrupt rearwardly facing surface or shoulder 143 of the body 48 which extends perpendicularly to the longitudinal axis of the body and an inwardly and rearwardly extending or sloping surface 143. It will be apparent that any particles of foreign matter trapped between the surface 49 and rod will tend to move into and be trapped in the grooves 140 as the tongue section slides over the rod. The rearwardly and outwardly sloping shoulders 144 will facilitate rolling movement of such particles relative to the rod and the tongue member until the tongue is in fully locked position on the rod. The particles trapped in the grooves will now increase the frictional force with which the tongue section is held against rearward movement on the rod since the abrupt shoulders 143 now will engage such particles upon any slight rearward movement of the tongue section on the rod and cause them to jam between the rod and the tongue section.

It will now be seen that a new and improved well tool has been illustrated and described which has a compression member compressible against a rod on which the tool is mounted and that the tool has two longitudinal telescopical body members which compress the compression member against the rod to lock the tool on the rod.

It will also be seen that the two well tool sections have co-engageable lock means at opposite ends thereof which permit telescopical movement of one section relative to the other in one longitudinal direction during which the two sections are moved toward one another and toward the rod, but which prevent movement of the one section in the opposite direction once the section nears the limit of its telescopical movement and the compression member is fully compressed.

It will also be apparent that the provision of the grooves 28 in the groove body section permits deformation or flow of portions of the compression member thereinto and thus increases the force with which the groove body section is held against movement relative to the compression member.

Figure 7:
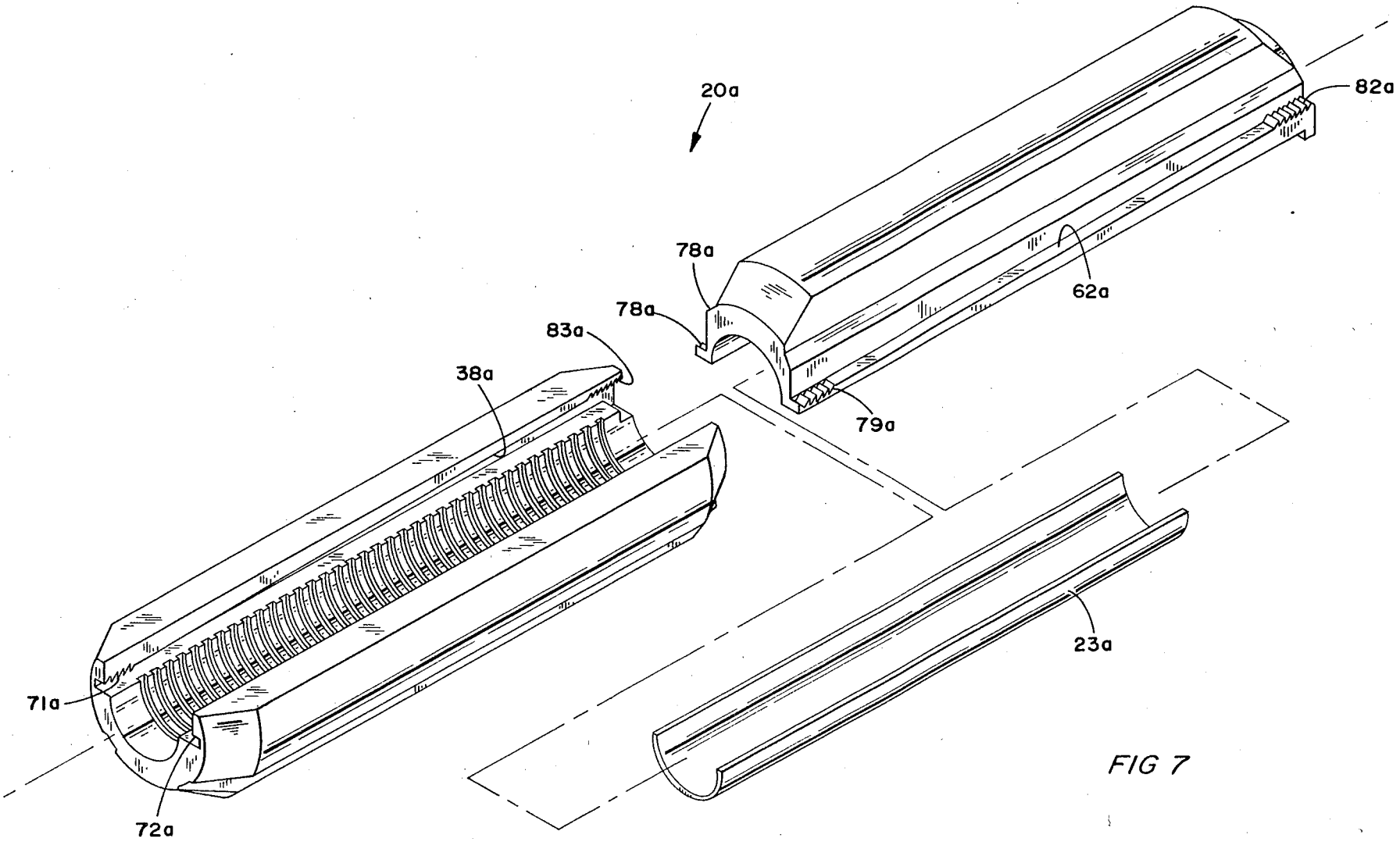
FIG. 7 is an exploded perspective view of another form of the well tool.

Referring now to FIG. 7 of the drawing, the well tool **20*a* is similar to the well tool 20 and, accordingly, its elements have been provided with the same reference numberals, to which the subscript "a" has been added, as the corresponding elements of the tool 20**.

The tool **20*a* differes from the tool 20 in that the front sets of teeth 71*a* and 72*a* extend downwardly from the cam surfaces 38*a* and 39*a* and are received in the upwardly opening teeth grooves 78*a* and 79*a* in the front portions of the cam surfaces 61*a* and 62*a*. Similarly, the rear sets of teeth, only one set 81*a* being visible, extend upwardly from the cam surfaces 61*a* and 62*a* and are receivable in the rear sets of teeth grooves, only one set 82*a* being visible, in the surfaces 38*a* and 39*a*** of the groove body sectional.

It will be apparent that if it is desired that the well tool be made of a very rigid substance, the tool **20*a* is preferred since no flexing of any portion thereof is required as the teeth engage and move past the teeth grooves since the compression member 23*a* will compress and then expand, and flow farther into or out of the grooves 28*a*** as the teeth move into and out of the teeth grooves as the tongue section moves toward fully locked position with the groove section.

It will be apparent that the tools 20 and 20*a* are used as centralizers since the ribs thereof extend parallel to their longitudinal axes. If it is desired to modify these tools to cause them to be scrapers, the ribs would be formed to extend at an angle to the longitudinal axis of the tool and thereabout as in the manner illustrated and described in the above mentioned United States Letters Patent to Pourchot, U.S. Pat. No. 3,399,730.

It will now be seen that a new and improved well tool mountable on a rod, such a rod of a pump rod string, has been illustrated and described which has two longitudinal sections, such as the sections 21 and 22, disposable about the rod and movable toward one another upon longitudinal telescopical movement of one section relative to the other by the camming engagement of co-engageable cam means and as the cam surfaces 38 and 39 of one section and the cam surfaces 61 and 62 of the other section, and a compressible member, such as the compression member 23 interposed between the rod and one of the sections which is compressed between such one section and the rod to hold the tool against movement on the rod.

It will also be seen that the two tool sections have co-engageable means, such as the sets of teeth 71, 72 and 81 and 82 and the sets of teeth grooves, such as the sets of teeth grooves 71 and 72 and 83 and 84 for holding the two tool sections against longitudinal movement relative to one another in direction to decrease the force with which the compression member is held in compression between the tool and the rod.

The foregoing description of the invention is explanatory only and changes in the details of the construction illustrated may be made by those skilled in the art within the scope of the appended claims without departing from the invention.

What I claim as new and desire to secure by Letters Patent is:

1. A well tool mountable on an elongate round rod including: a pair of complementary longitudinal sections having facing longitudinally extending substantially semicircular recesses in which the rod is receivable and a resilient compressible elongate member in said recess of one of said sections, said sections having first co-engageable means for moving the sections toward one another and compressing said compressible member between said one section and a rod extending through said recesses upon longitudinal movement of the other of said sections in one direction relative to said one of said sections, said one of said sections having transverse facing stop means for limiting longitudinal movement of said compressible member in said recess of said one of said sections, said sections having second co-engageable locking means for holding said other of said sections against longitudinal movement in a second direction opposite said one direction relative to said one of said sections when said compressible member is in compressed position between said one of said sections and the rod, said one section being provided with a plurality of longitudinally spaced transverse grooves opening to said recess of said one of said sections into which portions of said compressible member may move when said compressible member is compressed between said one of said sections and a rod.

* * * * *